US010207915B2

(12) United States Patent
Marchetto

(10) Patent No.: US 10,207,915 B2
(45) Date of Patent: Feb. 19, 2019

(54) EQUESTRIAN SADDLE

(71) Applicant: EQUILINE S.R.L., Trebaseleghe (PD) (IT)

(72) Inventor: Paolo Marchetto, Trebaseleghe (IT)

( * ) Notice: Subject to any disclaimer, the term of this patent is extended or adjusted under 35 U.S.C. 154(b) by 208 days.

(21) Appl. No.: 14/903,373

(22) PCT Filed: Jul. 18, 2014

(86) PCT No.: PCT/IB2014/063223

§ 371 (c)(1),
(2) Date: Jan. 7, 2016

(87) PCT Pub. No.: WO2015/008262

PCT Pub. Date: Jan. 22, 2015

(65) Prior Publication Data

US 2016/0145092 A1 May 26, 2016

(30) Foreign Application Priority Data

Jul. 19, 2013 (IT) ..... VI2013A0186

(51) Int. Cl.
*B68C 1/02* (2006.01)

(52) U.S. Cl.
CPC ..... *B68C 1/025* (2013.01); *B68C 1/02* (2013.01)

(58) Field of Classification Search
CPC ..... B68C 1/02; B68C 1/025
See application file for complete search history.

(56) References Cited

U.S. PATENT DOCUMENTS 47,771 A * 5/1865 Meeker ..... B68C 1/02 54/44.5
950,678 A * 3/1910 Reisacher ..... B68C 1/02 54/44.5
1,637,810 A * 8/1927 Eassie ..... B68C 1/02 54/66
5,740,665 A * 4/1998 Belton ..... B68C 1/04 54/44.1
6,332,307 B1 12/2001 Friedson
6,688,087 B2 * 2/2004 DeCosemo ..... B68C 1/02 54/44.1

(Continued)

FOREIGN PATENT DOCUMENTS

DE 3236079 A1 * 4/1983 ..... B68C 1/02
DE 3607565 A1 * 9/1986 ..... B68C 1/04

(Continued)

*Primary Examiner* — Son T Nguyen
(74) *Attorney, Agent, or Firm* — Themis Law

(57) ABSTRACT

An equestrian saddle includes a tree made of a substantially rigid material and defining a substantially vertical longitudinal center plane, a seating surface for the user, which is associated to the tree, and a pair of flaps arranged on opposite sides from the vertical plane and connected to the tree in a connection area proximate to the seating surface. Each flap includes at least one edge element having an outer surface with a relatively high friction coefficient for providing a grip on the user's leg. Each of the edge elements at least partially extends toward the connection area and is made of a material having a greater stiffness than the flaps for locally increasing resistance to wear caused by the user's leg rubbing thereon.

8 Claims, 4 Drawing Sheets

(56) References Cited

U.S. PATENT DOCUMENTS

| | | | | |
|---|---|---|---|---|
| 2006/0080946 | A1* | 4/2006 | DeCosemo | B68C 1/02 54/44.1 |
| 2007/0137149 | A1* | 6/2007 | Bates | B68C 1/02 54/44.5 |
| 2011/0271651 | A1* | 11/2011 | Morgan | B68C 1/126 54/44.1 |
| 2012/0192531 | A1* | 8/2012 | Zabala-Goetschel | B68C 1/02 54/44.1 |
| 2013/0199136 | A1* | 8/2013 | Woods | B68C 1/02 54/44.1 |
| 2013/0318932 | A1* | 12/2013 | Israel | B68C 1/00 54/66 |
| 2014/0102052 | A1* | 4/2014 | Bates | B68C 1/02 54/44.3 |

FOREIGN PATENT DOCUMENTS

| | | | | |
|---|---|---|---|---|
| DE | 19924383 | A1 * | 11/2000 | B68C 1/02 |
| DE | 202007003474 | | 6/2007 | |
| GB | 2113520 | A * | 8/1983 | B68C 1/04 |
| GB | 2279546 | A * | 1/1995 | B68C 1/00 |
| WO | WO-2009028005 | A1 * | 3/2009 | B68C 1/02 |

* cited by examiner

EQUESTRIAN SADDLE

FIELD OF THE INVENTION

The present invention generally finds application in the field of equine tack elements and particularly relates to an equestrian saddle.

BACKGROUND ART

In the field of animal tack elements, equestrian saddles are known to be used, which are designed to be placed on the back of a horse or an equine in general, for improving comfort and safety of the user as he/she sits during riding, Generally, saddles comprise a tree, which is placed in contact with the back of the animal, and is adapted to define a seating surface for the user, and a pair of lateral elements, typically known as flaps, which are directly connected to the tree on opposites side thereof.

The flaps are designed for the user to lie his/her legs thereon, thereby preventing direct contact between the legs and the sides of the animal.

Equestrian saddles are often equipped with gripping members at the lower edge of the flaps, for improving the grip of the user's leg to the saddle when riding.

Particularly, the gripping members may be paddings, coatings or shock-absorbing inserts sewn to the flaps.

A first drawback of this type of saddle consists in the particularly reduced size of the gripping members, which can promote contact with the user's leg only when the latter is substantially straight.

These members afford a considerably reduced or almost no grip when the user's legs are bent, like in the equestrian discipline of hurdle jumping.

Furthermore, these gripping members are usually made of a homogeneous and resilient material, which is different from the material of which flaps are made, to improve grip at the user's legs.

Nevertheless, the use of a homogeneous and resilient material may cause folding or crinkling of the flap edge as the user's legs move thereon, which may affect the overall comfort of the saddle, and be a nuisance for the saddled animal.

Furthermore, another drawback of this type of saddle is that these gripping members do not protect the lower portion of the flaps from the wear caused by the user's leg rubbing thereon.

DISCLOSURE OF THE INVENTION

The object of the present invention is to overcome the above drawbacks, by providing an equestrian saddle that is highly efficient and relatively cost-effective.

A particular object of the present invention is to provide an equestrian saddle that can promote the grip of user's legs over a large area of flap edges.

A particular object of the present invention is to provide an equestrian saddle that can promote the grip of user's legs on the flap irrespective of whether these legs are straight or bent.

A further object of the present invention is to provide an equestrian saddle that reduces or eliminates the formation of pleats and/or crinkles at the edge of the flap during use by a user.

Also, a further object of the present invention is to provide an equestrian saddle that is particularly comfortable both for the user and for the saddled animal.

Yet another object of the present invention is to provide an equestrian saddle that can reduce wear at the lower portion of the flaps, caused by the user's leg rubbing thereon.

These and other objects as better explained hereinafter, are fulfilled by an equestrian saddle as defined in claim 1, comprising a tree made of a substantially rigid material and defining a substantially vertical longitudinal center plane, a seating surface for the user, which is associated to the tree, a pair of flaps arranged on opposite sides from the vertical tree in a connection area proximate to said seating surface, wherein each flap comprises at least one edge element having an outer surface with a relatively high friction coefficient for providing a grip on the user's leg.

The saddle is characterized in that each of said edge elements at least partially extends toward the connection area and is made of a material having a greater stiffness than said flaps for locally increasing resistance to wear caused by the user's leg rubbing thereon.

Thanks to these features, an equestrian saddle can be provided that ensures a high degree of comfort for the user and an effective grip to the user's legs, straight or bent.

Advantageous embodiments of the invention will be defined in the dependent claims.

BRIEF DESCRIPTION OF THE DRAWING

Further features and advantages of the invention will be more apparent from the detailed description of a preferred, non-exclusive embodiment of an equestrian saddle according to the invention, which is described as a non-limiting example with the help of the annexed drawings, in which.

DETAILED DESCRIPTION OF A PREFERRED EMBODIMENT

Figure 1:
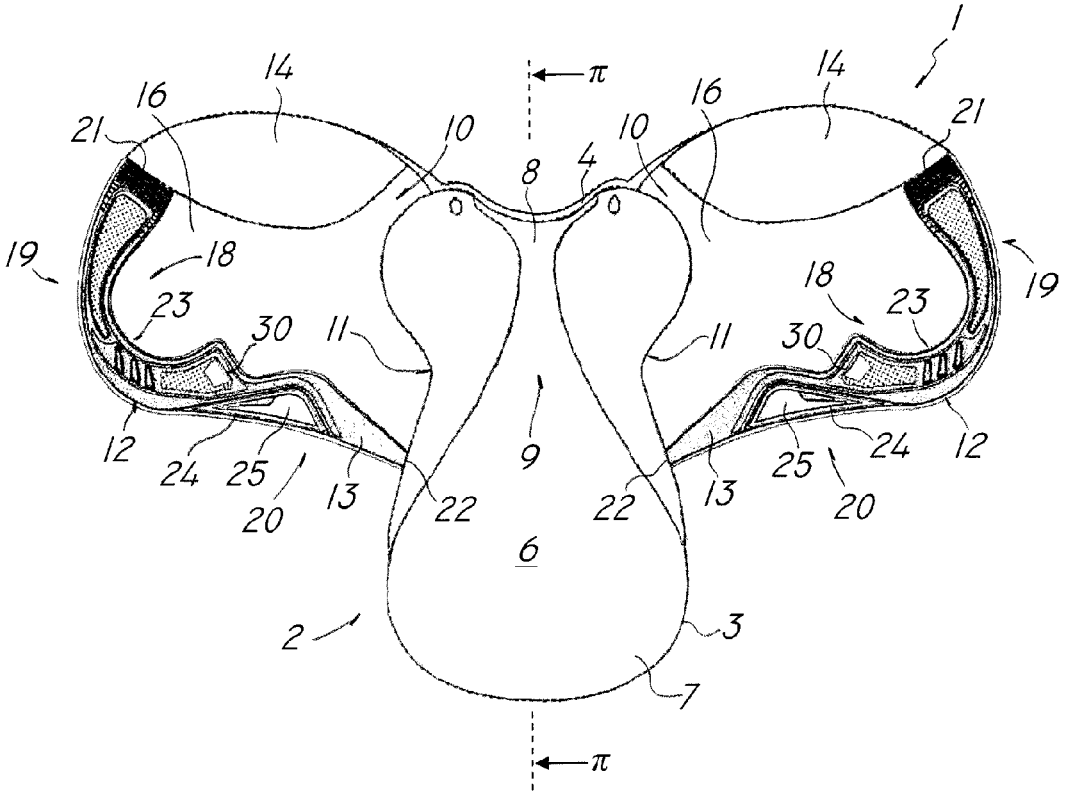
FIG. 1 is a top view of an equestrian saddle of the invention.

The above mentioned figures show an equestrian saddle, generally designated by numeral 1, which is designed to be placed on the back of a horse or an equine in general, for a user to sit and ride thereon.

Particularly, the equestrian saddle 1 is adapted to support the user in the right seated posture as he/she rides the equine.

Furthermore, the equestrian saddle 1 may be designed for use in various disciplines such as English riding, Western riding, eventing, trekking, dressage and the like.

The saddle 1 of the invention comprises a tree 2 made of a substantially rigid material and defining a substantially vertical longitudinal center plane $\pi$, a seating surface 3 for the user, which is associated to the tree 2.

Particularly, as best shown in the figures, the tree 2 may comprise a load-bearing element 4 made of a relatively rigid material, which has a bottom surface 5 designed for contact with the back of an equine and a top surface 6 facing the user.

Conveniently, the top surface 6 may be appropriately shaped to form the seating surface 3 for the user.

Such seating surface may comprise an enlarged back portion 7 defining the cantle, a narrower portion 8 defining the pommel and an even narrower intermediate portion 9 defining the seat for the user.

The saddle 1 further comprises a pair of flaps 10 arranged on opposite sides from the vertical plane π and connected to the tree 2 in a connection area 11 proximate to the seating surface 3.

The flaps 10 are designed to support the user's legs during use of the saddle 1, while preventing them from contacting the sides of the equine.

Figure 2:
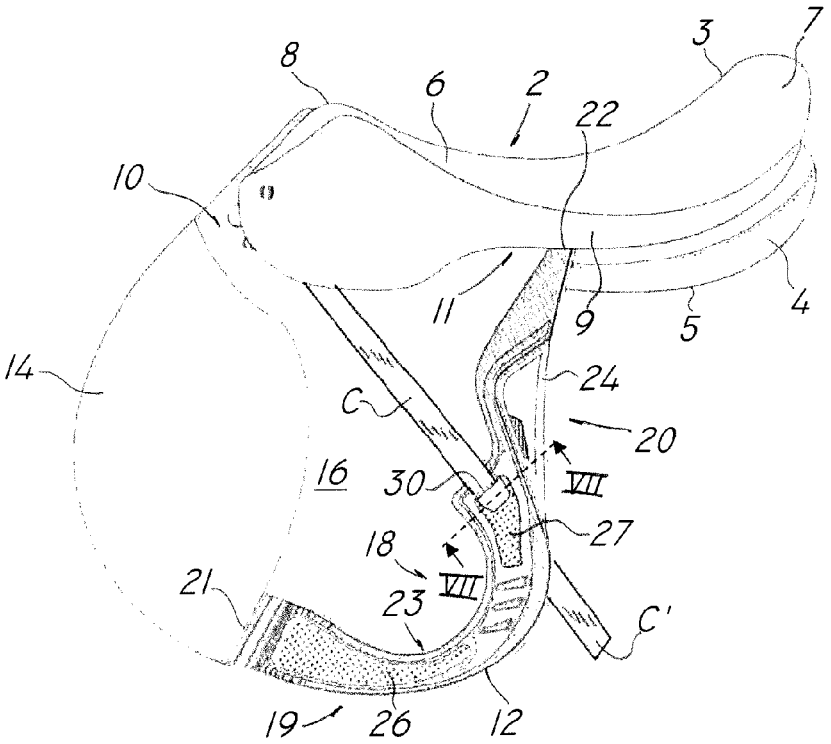
FIG. 2 is a side view of the saddle of FIG. 1.

The connection area 11, as best shown in FIG. 2, may be disposed at the intermediate portion 9 of the seating surface 3.

Each flap 10 comprises an edge element 12, as shown in FIG. 1, having an outer surface 13 with a relatively high friction coefficient for providing a grip on the user's leg.

According to a peculiar characteristic of the invention, each of the edge elements 12 at least partially extends toward the connection area 11 and is made of a material having a greater stiffness than the flaps 10 for locally increasing resistance to wear caused by the user's leg rubbing thereon.

In the embodiment as shown in the figures, the saddle 1 comprises a pair of edge elements 12 which are stably secured to their respective flaps 10.

The extension of the edge element 12 toward the connection area 11 provides optimized grip on the legs of the user of the saddle 1 even when the rider has bent legs, which occurs, for instance, during hurdle jumping.

Conveniently, each of the flaps 10 may comprise a padded front portion 14, one being only visible in FIG. 2, which is adapted to absorb riding-related shocks at the user's knees.

Furthermore, each flap 10 may be formed with a first semirigid inner layer 15 made of hard leather or the like, which is designed to contact the sides of the animal, and a soft outer layer 16 made of soft leather, which overlies the inner layer 15.

Each edge element 12 may be made of a substantially rigid or semirigid material, which may be selected from the group comprising polymeric materials, such as deformable plastic materials and rubber.

The use of a polymeric material for the edge elements 12 increases the grip on user's legs at the flap 10 during use of the saddle 1 and provides relatively high wear resistance and durability, higher than that of the soft outer layer 16 of the flap 10.

Each edge element 12 has an inner surface 17 which is designed to at least partially cover the outer layer 16 of the flap 10.

In the configuration of the invention as shown in the figures, the pair of edge elements 12 entirely cover area 18 of the outer layer 16 of the flaps 10 extending from the padding 14 to the connection area 11.

Figure 4:
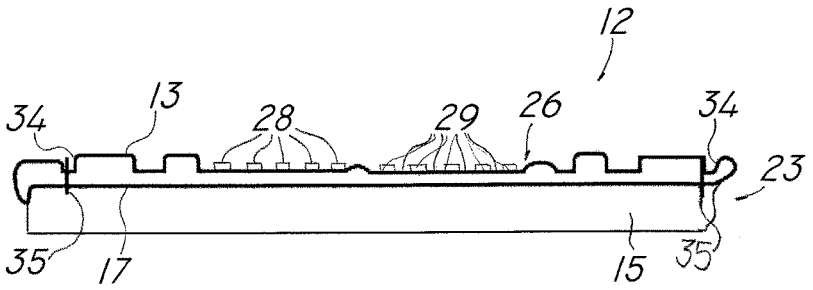
FIGS. 4 to 6 are cross sectional side views of the detail of the FIG. 3, as taken along planes III-Ill, IV-IV and V-V respectively.

In the embodiment as shown in FIGS. 2 and 4, each edge element 12 may comprise a curved lower portion 19 and a substantially straight upper portion 20.

The edge element 12 may comprise two ends 21 associated with the lower portion 19 and the upper portion 20 respectively.

Particularly, as well shown in FIG. 2, the end 21 associated with the lower portion 19 may be secured to the flap 10 near or in contact with the padding 14, whereas the other end 22 associated with the straight portion 20 may be secured to the connection area 11 near or in contact with the tree 2.

Advantageously, the upper portion 20 may be stiffer than the curved lower portion 19.

This feature will improve the overall comfort of the saddle 1 because, as the user's legs rub against the edge element 12, no pleats or crinkles will be formed at the junction area 23 between the edge element 12 and the flap 10.

Figure 3:
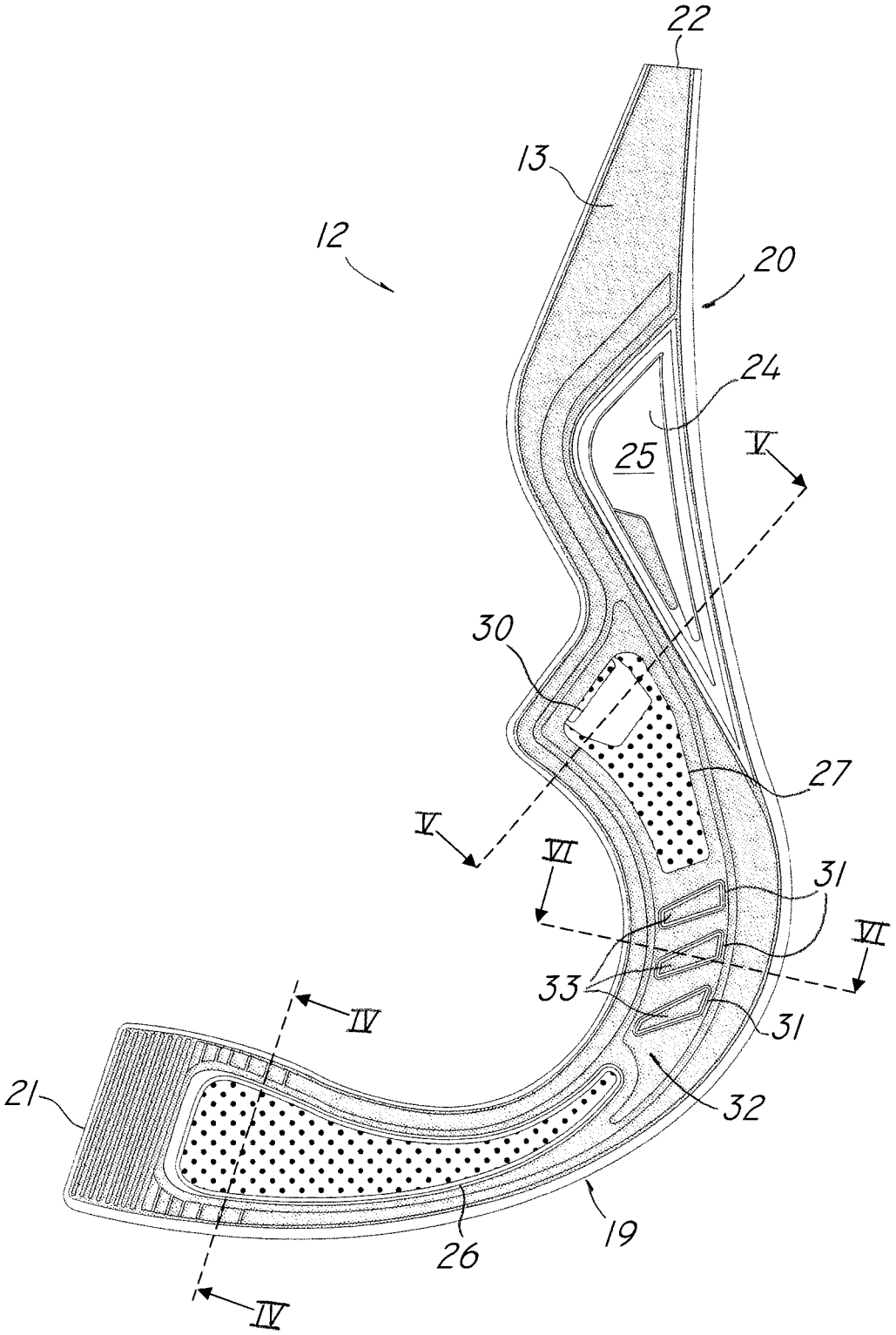
FIG. 3 is a side view of a detail of FIG. 1.

Conveniently, as best shown in FIGS. 1, 3 and 4, the stiffer upper portion may comprise a specially shaped insert 24 made of metal or the like, secured to the outer surface 13 of the edge element 12.

Conveniently, the insert 24 may be secured to the outer surface 13 of the upper portion 20 by bonding, molding, co-molding or other similar processes.

Furthermore, the insert 24 may have an upper portion 25 visible to the user, upon which identification graphics, symbols, text or marks, not shown, may be provided.

Figure 5:
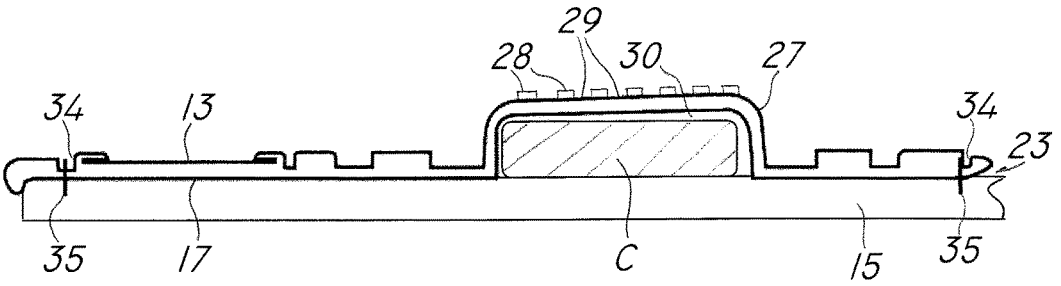

The outer surface 13 of each edge element 12, as best shown in FIGS. 3 to 5, may have areas 26, 27 with differentiated friction coefficients.

Thus, the edge element 12 may provide differentiated grip effects on the user's legs at such areas 26, 27.

Conveniently, the friction coefficient of each area 26, 27 may be provided by an appropriate finish of the outer surface 13 of the edge elements 12.

Particularly, as best shown in FIGS. 4 and 5, this finish may be provided by projections 28 from a flat surface 29, at such areas 26, 27, for improving retention of the user's legs.

Advantageously, the projections 28 are evenly arranged over the surface 29 in the differentiated friction areas 26, 27 and may have circular or polygonal plan shapes.

Of course, by appropriately changing the shape and arrangement of the projections 28 in the various areas 26, 27 the friction coefficient of the top surface 13 of the edge element 12 may be increased or decreased.

In the configuration of the invention as shown in the figures, the edge element 12 comprises two areas 26, 27 with differentiated friction coefficients, which are placed in the lower portion 19 and the upper portion 20 respectively.

Particularly, the two areas 26, 27 may have the same friction coefficient, such that these portions 19 and 20 may promote an even grip on the user's leg.

Figure 7:
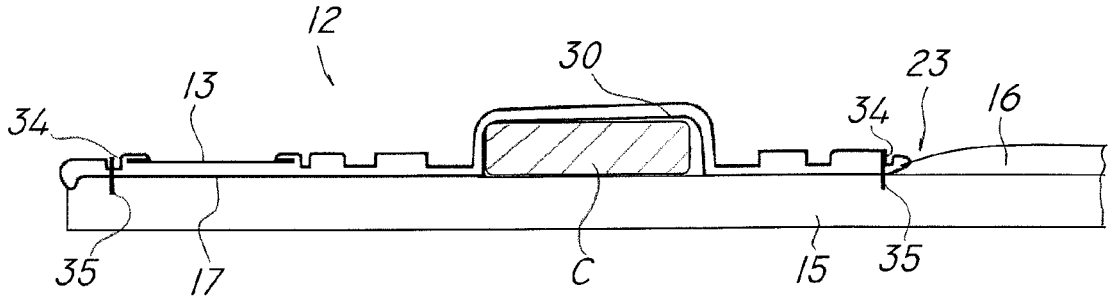
FIG. 7 is a cross sectional side view of the saddle of FIG. 2, as taken along plane VII-VII.

Furthermore the edge element 12 may have a through slot 30, as best shown in FIGS. 2, 5 and 7 for receiving the end section C' of a stirrup leather C.

This slot 30, as well shown in FIG. 7, may be adapted to receive the end section C' of the stirrup leather C between the inner surface 17 of the edge element 12 and the outer layer 15 of the flap 10.

Due to the passage of the stirrup leather C through the slot 30, the outer surface 13 of the edge element 12 may be left uncovered, thereby affording comfortable and unhindered movements for the user's legs.

As shown in FIG. 3, the through slot 30 may be formed in the differentiated friction-coefficient area 27 located at the upper portion 20 of the edge element 12.

Figure 6:
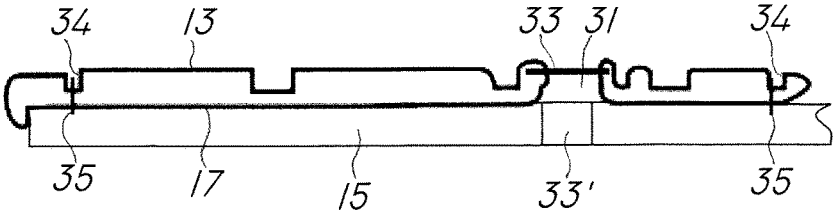

In an optional embodiment, as shown in FIGS. 3 and 6, the edge elements 12 may comprise first through openings 31 and the flaps 10 may comprise second through openings 33'.

Preferably, the first through openings 31 may be aligned with the second through openings 33' to allow air to pass therein.

Such alignment of the first 31 and second 33' through openings will provide ventilation to the sides of the equine for sweat evaporation.

Conveniently, the first through openings 31 may be formed in an intermediate area 32 of the edge element 12 between the two areas with differentiated friction coefficients 26, 27.

Preferably, the first openings 31 may be at least partially covered with breathable or perforated fabric 33 for promoting air flow toward the side of the equine and vice versa.

The edge elements 12 may be secured to the pair of flaps 10 by sewing.

For instance, as well shown in FIG. 7, the edge element 12 may be directly sewn on the semirigid inner layer 15 of its respective flap 10.

In this case, the outer layer 16 of the flap 10 may be later laid over the inner layer 15, in juxtaposed relation to the edge element 12, to prevent any projection or step from forming at the junction area 23 of the edge element with the flap 10.

Conveniently, each edge element 12 may comprise one or more specially shaped grooves 34, as best shown in the sectional views of FIGS. 4 to 7, which are formed on the outer surface 13 thereof for accommodating the seams 35 that secure it to its respective flap 10.

The specially shaped grooves 34 may also define the seam line that sews up the edge element 12 to the corresponding flap 10. Furthermore, the plan shape of these grooves 34 may be substantially complementary or similar to the plan shape of the edge element 12, extending both in the upper portion 20 and in the lower portion 19 thereof.

The above disclosure clearly shows that the invention fulfills the intended objects, and particularly the object of providing an equestrian saddle that can improve the grip of the user's legs on the flaps, and afford high comfort and strength.

The equestrian saddle of the invention is susceptible of a number of changes and variants, within the inventive concept as disclosed in the appended claims. All the details thereof may be replaced by other technically equivalent parts, and the materials may vary depending on different needs, without departure from the scope of the invention.

While the equestrian saddle has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The equestrian saddle of the present invention may be manufactured by industries that produce animal tack elements, particularly for equines.

The invention claimed is:

1. An equestrian saddle, comprising:

a tree (2) made of a substantially rigid material and defining a substantially vertical longitudinal center plane ($\pi$), said tree being designed to be placed in contact with an animal;

a seating surface (3) for a user, which is associated to said tree (2); and a pair of flaps (10) arranged on opposite sides from said vertical longitudinal plane ($\pi$) and connected to said tree (2) in a connection area (11) proximate to said seating surface (3);

wherein each flap (10) has an external profile with a peripheral edge;

wherein each flap (10) comprises a front portion, a rear portion, and an edge element (12) disposed along said peripheral edge proximate to said rear portion;

wherein each flap (10) is composed of a first semirigid inner layer (15), which is designed to contact a side of the animal, and a soft outer layer (16), which overlies said inner layer;

wherein said edge element (12) of each flap (10) at least partially extends toward said connection area (11);

wherein each edge element (12) has an inner surface (17), which is designed to cover at least partially the outer layer (16) of the corresponding flap (10);

wherein each edge element (12) has an outer surface (13) with a relatively high friction coefficient for providing a grip on a user's leg;

wherein each edge element (12) is made of a material having a greater stiffness than said flaps (10) for locally increasing resistance to wear caused by the user's leg rubbing thereon;

wherein each edge element (12) comprises a lower portion (19) and an upper portion (20) stiffer than the lower portion (19), said upper and lower portions having respective areas (26, 27) with differentiated friction coefficients; and wherein said differentiated friction coefficients in said respective areas are caused by surfaces having differentiated projections (28).

2. The equestrian saddle claimed in claim 1, wherein said lower portion (19) is substantially curved and said upper portion (20) is substantially straight.

3. The equestrian saddle claimed in claim 1, wherein said projections (28) are evenly arranged in said areas (26, 27) and have a circular or polygonal plan shape.

4. The equestrian saddle claimed in claim 1, wherein said stiffer upper portion (20) comprises an insert (24) made of a metal material, which is bonded, molded, or co-molded to said outer surface (13).

5. The equestrian saddle claimed in claim 1, wherein said edge element (12) has a through slot (30) for receiving an end section (C') of a stirrup leather (C) such that said stirrup leather extends between an inner surface (17) of said edge element (12) and said flap (10).

6. The equestrian saddle claimed in claim 1, wherein said edge element (12) has a first through opening (31) substantially aligned with a second through opening (33') formed in one of said flaps (10) for allowing air to pass therein.

7. The equestrian saddle claimed in claim 1, wherein each edge element (12) is sewn to a respective flap (10) to form a corresponding seam (35).

8. The equestrian saddle claimed in claim 7, wherein said edge element (12) comprises one or more specially shaped grooves (34) formed on the outer surface (13) for accommodating said seam (35) that secures said edge element to its respective flap (10).

* * * * *